US007216946B2

(12) United States Patent
Yamamoto et al.

(10) Patent No.: US 7,216,946 B2
(45) Date of Patent: May 15, 2007

(54) INK FEEDING RATE CONTROL METHOD AND DATA CORRECTING METHOD FOR A PRINTING MACHINE

(75) Inventors: Takaharu Yamamoto, Kyoto (JP); Kazuya Takeda, Kyoto (JP); Kazuki Fukui, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 225 days.

(21) Appl. No.: 10/774,538

(22) Filed: Feb. 10, 2004

(65) Prior Publication Data

US 2004/0177784 A1 Sep. 16, 2004

(30) Foreign Application Priority Data

Mar. 14, 2003 (JP) ..... 2003-069790

(51) Int. Cl.
*B41J 29/38* (2006.01)

(52) U.S. Cl. ..... 347/6; 347/19

(58) Field of Classification Search ..... 347/6, 347/19

See application file for complete search history.

(56) References Cited

U.S. PATENT DOCUMENTS 6,494,557 B1 * 12/2002 Kato et al. ..... 347/19
6,601,512 B2 8/2003 Yamamoto et al.
6,684,780 B2 * 2/2004 Shiraishi ..... 101/365
6,900,789 B2 * 5/2005 Matsuura et al. ..... 345/107
2003/0011798 A1 1/2003 Yamamoto et al.
2003/0107609 A1 * 6/2003 Shiraishi ..... 347/6

FOREIGN PATENT DOCUMENTS

JP 2002-355950 12/2002

* cited by examiner

*Primary Examiner*—Stephen Meier
*Assistant Examiner*—Jason Uhlenhake
(74) *Attorney, Agent, or Firm*—McDermott Will & Emery LLP

(57) ABSTRACT

An ink feeding rate control method for a printing machine includes a step of determining, from image data used in recording images, an average of image area ratios of images in areas on prints corresponding to ink keys, a step of determining, from the image data, an average of image area ratios of images in positions aligned in a printing direction with the detecting patches (i.e. rectangular areas having substantially the same width as the detecting patches and extending in the printing direction) printed in the areas on the prints corresponding to the ink keys, and a step of correcting the reference information based on the average of image area ratios of the images in the areas on the prints corresponding to the ink keys, and the average of image area ratios of the images in the positions aligned in the printing direction with the detecting patches printed on the prints.

12 Claims, 11 Drawing Sheets

INK FEEDING RATE CONTROL METHOD AND DATA CORRECTING METHOD FOR A PRINTING MACHINE

BACKGROUND OF THE INVENTION

1. Field of the Invention

This invention relates to an ink feeding rate control method for controlling an ink feeding rate for each area corresponding to an ink key of an ink feeder in a printing machine based on measurement information on detecting patches printed on prints. Further, the invention relates to a data correcting method for a printing machine for correcting data such as measurement information on detecting patches in order to control an ink feeding rate and/or a dampening water feeding rate.

2. Description of the Related Art

Such a printing machine includes ink feeders for adjusting the rates of feeding inks to ink rollers. Each ink feeder has a plurality of ink keys juxtaposed in a direction perpendicular to a direction for transporting printing paper in time of printing. The rate of feeding ink to the ink rollers is adjusted by varying the opening degree of each ink key. In this way, the rate of feeding ink ultimately to a printing plate is adjusted.

The printing plate has regions called detecting patches or control strips formed in positions corresponding to the respective ink keys. The opening degree of each ink key is adjusted by measuring, with a densitometer, the color density of a corresponding detecting patch actually printed on printing paper (see Japanese Unexamined Patent Publication No. 2002-355950, for example).

FIG. 11 is an explanatory view schematically showing detecting patches P1, P2, P3 and P4 printed on printing paper S acting as a print.

Each of areas E1, E2 and so on of the printing paper S corresponding to the respective ink keys of ink feeders has printed therein, for example, a detecting patch P1 corresponding to cyan ink, a detecting patch P2 corresponding to magenta ink, a detecting patch P3 corresponding to yellow ink, and a detecting patch P4 corresponding to black ink.

Specifically, as shown in FIG. 11, where a plurality of cyan images I are printed on the printing paper S, the area E1 has no images I in an area e1 aligned with the detecting patch P1 in the printing direction (i.e. a rectangular area having substantially the same width as the detecting patch and extending in the printing direction). On the other hand, the area E2 has a plurality of images I arranged in an area e2 aligned with the detecting patch P1 in the printing direction (i.e. a rectangular area having substantially the same width as the detecting patch and extending in the printing direction).

With such prints, cyan ink is little consumed in an image area of a printing plate corresponding to the area e1. The detecting patch P1 in the area E1 has a relatively high color density of cyan ink. Thus, the ink feeder is controlled to reduce the feeding rate of cyan ink for the area E1. Conversely, cyan ink is consumed in a relatively large quantity in an image area of the printing plate corresponding to the area e2. The detecting patch P1 in the area E2 has a relatively low color density of cyan ink. Thus, the ink feeder is controlled to increase the feeding rate of cyan ink for the area E2.

There can be a difference between an image area of areas e1, e2 and so on aligned with the detecting patches P1, P2, P3 and P4 in the printing direction (i.e. rectangular areas having substantially the same width as the detecting patches and extending in the printing direction) and an average image area of the areas E1, E2 and so on having these detecting patches P1, P2, P3 and P4 arranged therein. In such a case, the ink feeding rate cannot be controlled accurately. Such a drawback constitutes a serious problem particularly where each ink feeder of the printing machine has a small number of ink rollers with a low effect of ink distribution.

SUMMARY OF THE INVENTION

The object of this invention, therefore, is to provide an ink feeding rate control method and a data correcting method for a printing machine capable of accurately controlling an ink feeding rate regardless of images to be printed.

The above object is fulfilled, according to this invention, by an ink feeding rate control method for controlling a feeding rate of ink for each of areas corresponding to ink keys of an ink feeder in a printing machine, by comparing measurement information and reference information on detecting patches printed on prints, the method comprising the steps of determining an average of image area ratios of images in the areas on the prints corresponding to the ink keys, determining an average of image area ratios of images in positions aligned in a printing direction with the detecting patches printed in the areas on the prints corresponding to the ink keys, and correcting one of the reference information and the measurement information based on the average of image area ratios of the images in the areas on the prints corresponding to the ink keys, and the average of image area ratios of the images in the positions aligned in the printing direction with the detecting patches printed on the prints.

This ink feeding rate control method can control the ink feeding rate accurately and easily regardless of the images to be printed. It is thus possible to avoid the drawback noted hereinbefore that the ink feeding rate cannot be controlled accurately.

In a preferred embodiment of the invention, the measurement information on the detecting patches comprises densities of the detecting patches, and the reference information comprises reference densities.

In another preferred embodiment, the reference information or measurement information is corrected by using a correction factor obtained empirically.

Preferably, a corrected value of the reference information or measurement information is stored from time to time, and the reference information or measurement information is corrected in time of subsequent printing processes by using the corrected value stored.

In another aspect of this invention, an ink feeding rate control method is provided for a printing machine having an image recorder for recording images on a printing plate based on image data, for controlling a feeding rate of ink for each of areas corresponding to ink keys of the ink feeder by comparing measurement information and reference information on detecting patches printed on prints, the method comprising the steps of determining, from the image data, an average of image area ratios of images in the areas on the prints corresponding to the ink keys, determining, from the image data, an average of image area ratios of images in positions aligned in a printing direction with the detecting patches printed in the areas on the prints corresponding to the ink keys, and correcting one of the reference information and the measurement information based on the average of image area ratios of the images in the areas on the prints corresponding to the ink keys, and the average of image area ratios of the images in the positions aligned in the printing direction with the detecting patches printed on the prints.

In a further aspect of this invention, a data correcting method for a printing machine is provided for correcting one of measurement information and predetermined reference information when controlling the printing machine by comparing the measurement information and the reference information, the measurement information being obtained by measuring detecting patches printed on prints and corresponding to ink keys of the printing machine, the method comprising the steps of determining an average of image area ratios of images in the areas on the prints corresponding to the ink keys, determining an average of image area ratios of images in positions aligned in a printing direction with the detecting patches printed in the areas on the prints corresponding to the ink keys, and correcting one of the reference information and the measurement information based on the average of image area ratios of the images in the areas on the prints corresponding to the ink keys, and the average of image area ratios of the images in the positions aligned in the printing direction with the detecting patches printed on the prints.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of the invention will be described hereinafter with reference to the drawings.

<Construction of Printing Machine>

Figure 1:
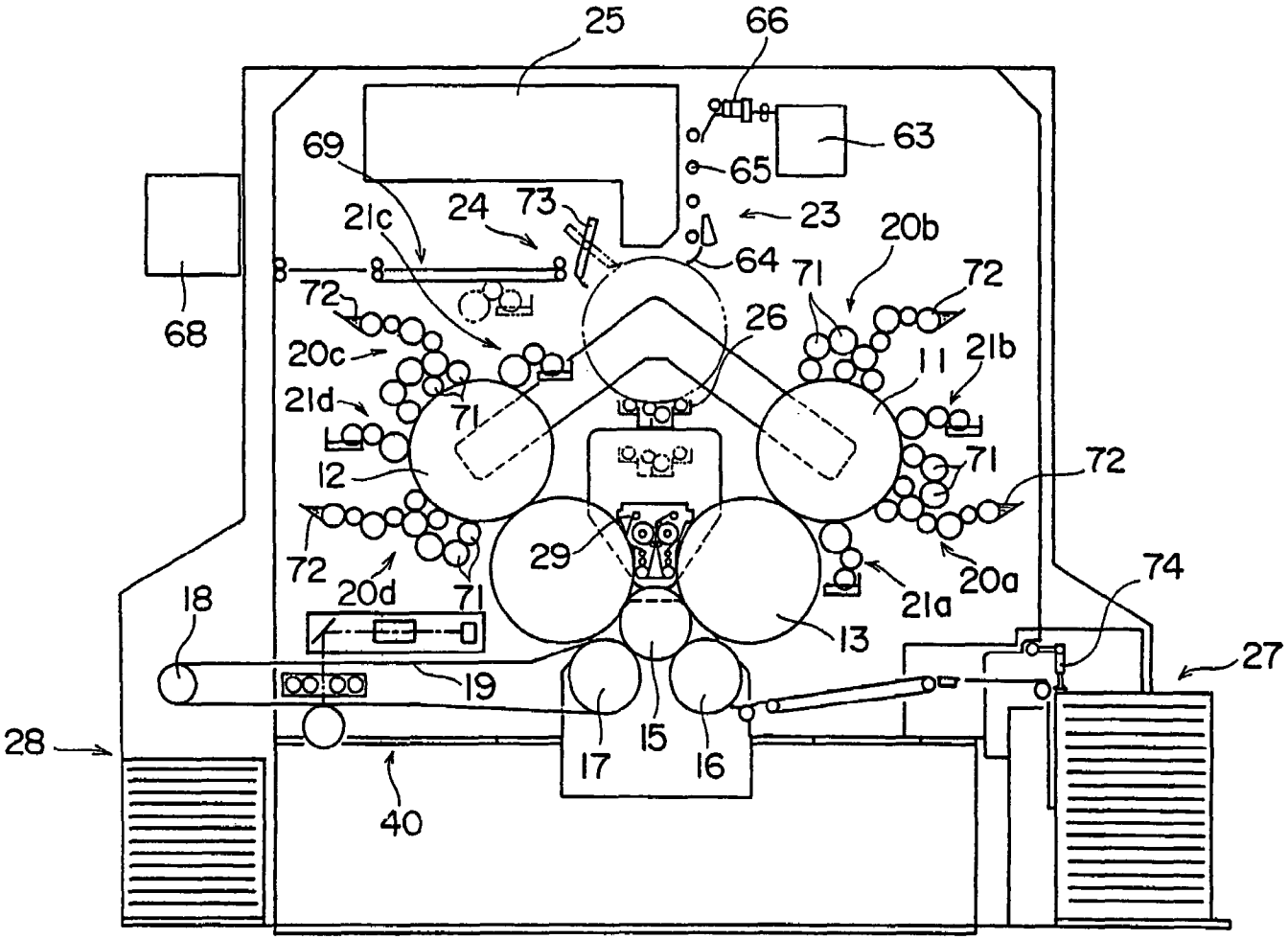
FIG. 1 is a schematic side view of a printing machine according to this invention.

A construction of a printing machine according to this invention will be described first. FIG. 1 is a schematic view of the printing machine according to this invention.

This printing machine records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The machine further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, an image pickup station 40 for measuring color densities of detecting patches printed on the printing paper, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of clamping jaws, not shown, for clamping the forward and rear ends of the plate fed from the plate feeder 23.

The plate remover 24 has a blade mechanism 73 for separating a plate from the first or second plate cylinder 11 or 12 after a printing operation, a discharge cassette 68, and a conveyor mechanism 69 for transporting the plate separated by the blade mechanism 73 to the discharge cassette 68.

The forward end of the plate drawn from the feeder cassette 63 is guided by the guide rollers 65 and guide member 64, and clamped by one of the clamping jaws on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is clamped by the other clamping jaw. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
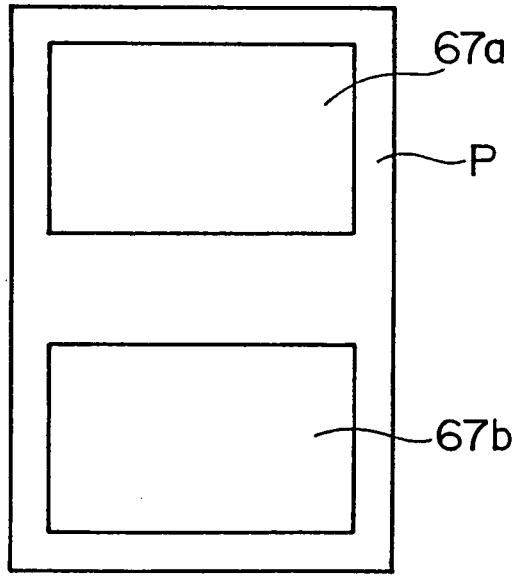
FIG. 2A is an explanatory view showing an arrangement of image areas on a printing plate, one for printing in black ink and the other for printing in magenta ink.
Figure 2B:
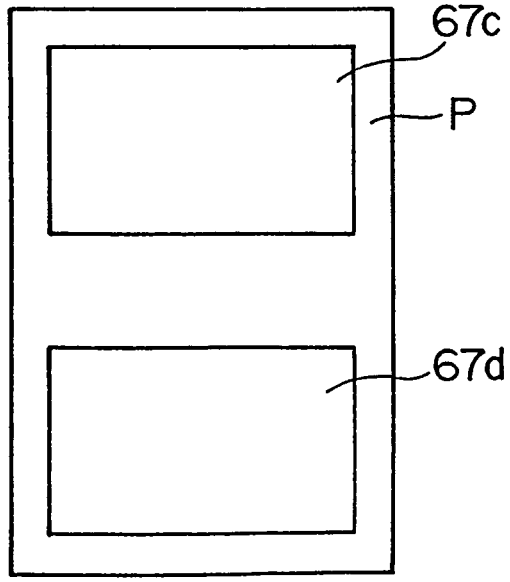
FIG. 2B is an explanatory view showing an arrangement of image areas on a printing plate, one for printing in cyan ink and the other for printing in yellow ink.

On the plate P mounted peripherally of the first plate cylinder 11, the image recorder 25, as shown in FIG. 2A, records an image area 67*a* to be printed with black ink, and an image area 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an ink source 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Figure 3:
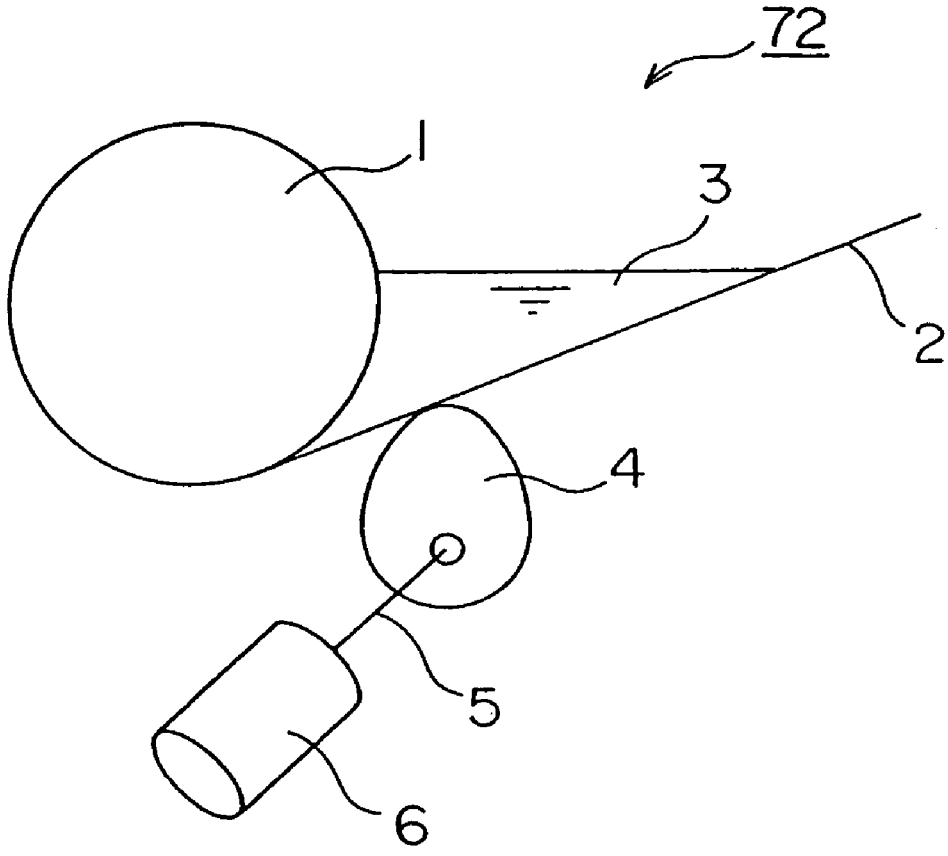
FIG. 3 is a schematic side view of an ink source.
Figure 4:
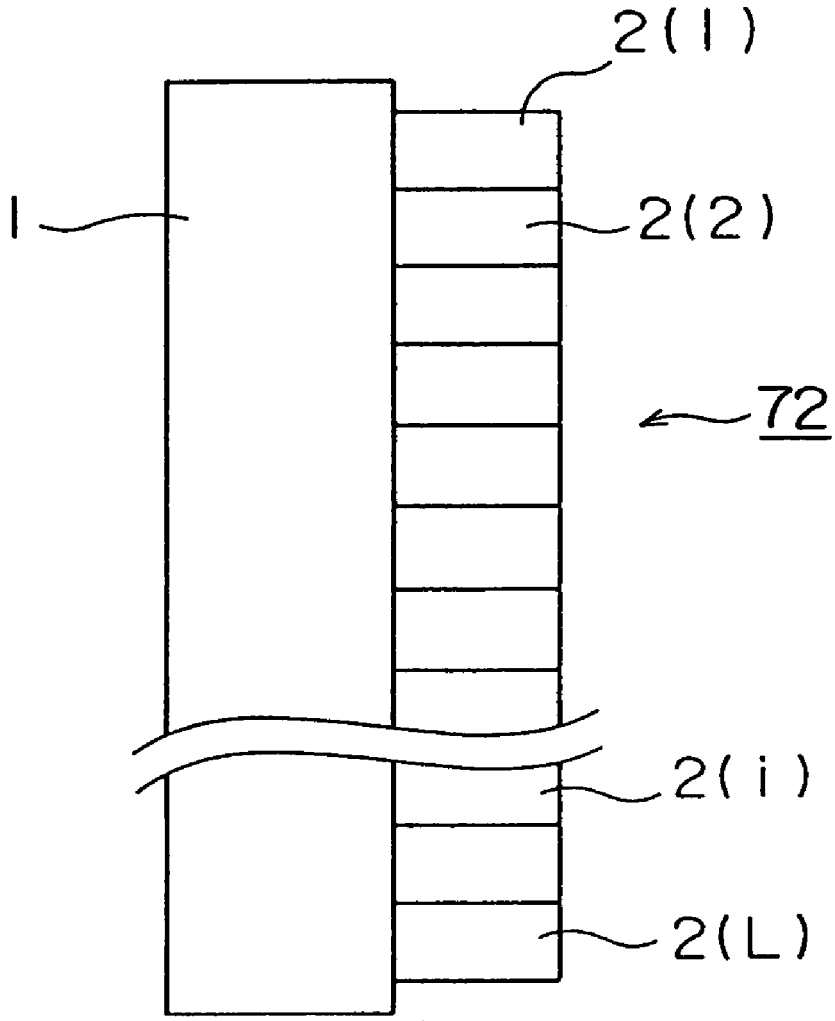
FIG. 4 is a plan view of the ink source.

FIG. 3 is a schematic side view of the ink source 72 noted above. FIG. 4 is a plan view thereof. Ink 3 is omitted from FIG. 4.

The ink source 72 includes an ink fountain roller 1 having an axis thereof extending in a direction of width of printed matter (i.e. perpendicular to a printing direction of the printing machine), and ink keys 2 (1), 2 (2) . . . 2 (L) arranged in the direction of width of the printed matter. (In this specification, these ink keys may be collectively called "ink keys 2".) The ink keys 2 correspond in number to the number L of areas divided in the direction of width of the printed matter. Each of the ink keys 2 has an adjustable opening degree with respect to the outer periphery of the ink fountain roller 1. The ink fountain roller 1 and ink keys 2 define an ink well for storing ink 3.

Eccentric cams 4, L in number, are arranged under the respective ink keys 2 for pressing the ink keys 2 toward the surface of ink fountain roller 1 to vary the opening degree of each ink key 2 with respect to the ink fountain roller 1. The eccentric cams 4 are connected through shafts 5 to pulse motors 6, L in number, for rotating the eccentric cams 4, respectively.

Each pulse motor 6, in response to an ink key drive pulse applied thereto, rotates the eccentric cam 4 about the shaft 5 to vary a pressure applied to the ink key 2. The opening degree of the ink key 2 with respect to the ink fountain roller 1 is thereby varied to vary the rate of ink fed to the printing plate.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 5:
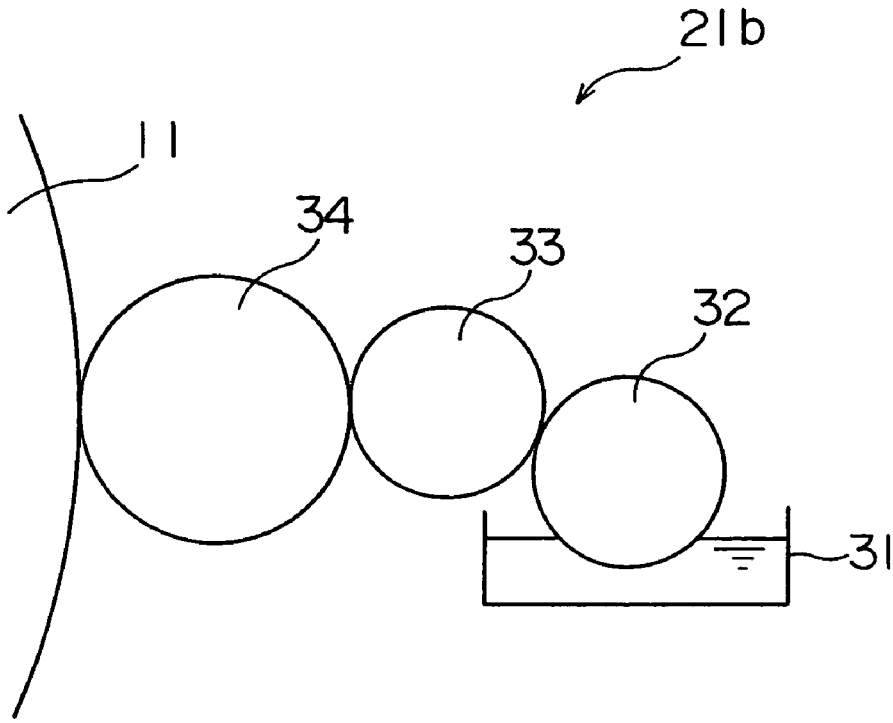
FIG. 5 is a schematic side view of a dampening water feeder.

FIG. 5 is a schematic side view of the dampening water feeder 21*b*.

The dampening water feeder 21*b* includes a water source having a water vessel 31 for storing dampening water and a water fountain roller 32 rotatable by a motor, not shown, and two water rollers 33 and 34 for transferring dampening water from the fountain roller 32 to the surface of the plate mounted peripherally of the first plate cylinder 11. This dampening water feeder is capable of adjusting the rate of feeding dampening water to the surface of the plate by varying the rotating rate of fountain roller 32.

The three other water feeders 21*a*, 21*c* and 21*d* have the same construction as the water feeder 21*b*.

Referring again to FIG. 1, the developing device 26 is disposed under the first plate cylinder 11 or second plate cylinder 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 41 arranged thereon. When the impression cylinder 15 transfers the printing paper to the discharge cylinder 17, one of the grippers 41 of the discharge cylinder 17 holds the forward end of the printing paper having been held by the gripper of the impression cylinder 15. With movement of the chains 19, color densities of the detecting patches printed on the printing paper are measured at the image pickup station 40. Thereafter the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 6:
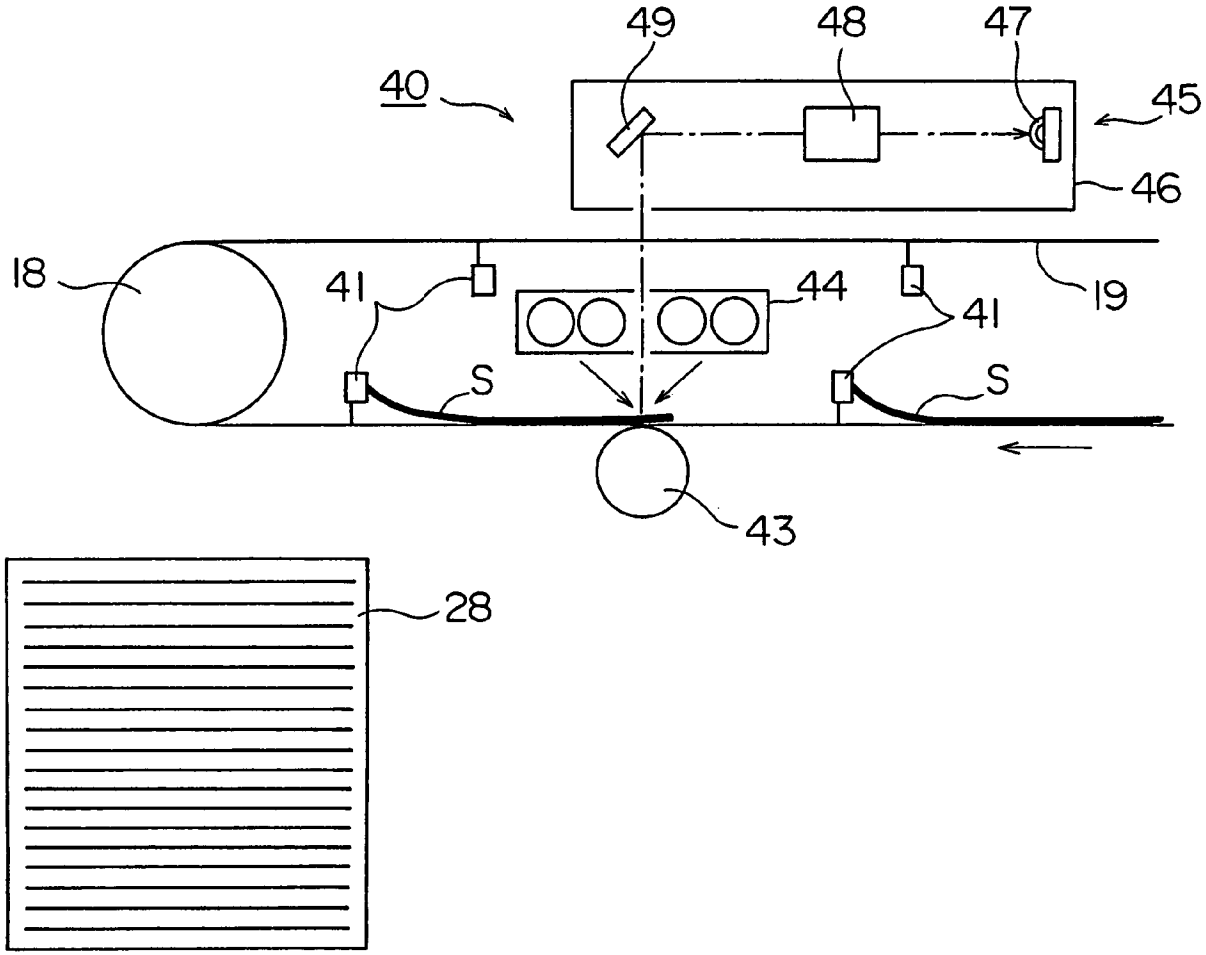
FIG. 6 is a schematic side view of an image pickup station shown with chains.

FIG. 6 is a schematic side view of the image pickup station 40 for measuring color densities of the detecting patches printed on the printing paper, which is shown with the chains 19.

The pair of chains 19 are endlessly wound around the opposite ends of the paper discharge cylinder 17 shown in FIG. 1 and a pair of large sprockets 18. As noted hereinbefore, the chains 19 are interconnected by coupling members, not shown, having a plurality of grippers 41 arranged thereon each for gripping a forward end of printing paper S transported.

The pair of chains 19 have a length corresponding to a multiple of the circumference of paper discharge cylinder 17. The grippers 41 are arranged on the chains 19 at intervals each corresponding to the circumference of paper discharge cylinder 17. Each gripper 41 is opened and closed by a cam mechanism, not shown, synchronously with the gripper on the paper discharge cylinder 17. Thus, each gripper 41 receives printing paper S from the paper discharge cylinder 17, transports the printing paper S with rotation of the chains 19, and discharges the paper S to the paper discharge station 28.

The printing paper S is transported with only the forward end thereof held by one of the grippers 41, the rear end of printing paper S not being fixed. Consequently, the printing paper S could flap during transport, which impairs an operation, to be described hereinafter, of the image pickup station 40 to measure densities of the detecting patches. To avoid such an inconvenience, this printing machine provides a suction roller 43 disposed upstream of the paper discharge station 28 for stabilizing the printing paper S transported.

The suction roller 43 is in the form of a hollow roller having a surface defining minute suction bores, with the hollow interior thereof connected to a vacuum pump not shown. The suction roller 43 is disposed to have an axis thereof extending parallel to the grippers 41 bridging the pair of chains 19, a top portion of the suction roller 43 being substantially at the same height as a lower run of the chains 19.

The suction roller 43 is driven to rotate or freely rotatable in a matching relationship with a moving speed of the grippers 41. Thus, the printing paper S is drawn to the surface of the suction roller 43, thereby being held against flapping when passing over the suction roller 43. In place of the suction roller 43, a suction plate may be used to suck the printing paper S two-dimensionally.

The image pickup station 40 includes an illuminating unit 44 for illuminating the printing paper S transported, and an image pickup unit 45 for picking up images of the detecting patches on the printing paper S illuminated by the illuminating unit 44 and measuring color densities of the patches. The illuminating unit 44 is disposed between the upper and lower runs of chains 19 to extend along the suction roller 43, and has a plurality of linear light sources for illuminating the printing paper S over the suction roller 43.

The image pickup unit 45 includes a light-shielding and dustproof case 46, and a mirror 49, a lens 48 and a CCD line sensor 47 arranged inside the case 46. The image pickup unit 45 picks up the image of printing paper S over the suction roller 43 through slits of the illuminating unit 44. Incident light of the image reflected by the mirror 49 passes through the lens 48 to be received by the CCD line sensor 47.

Figure 7:
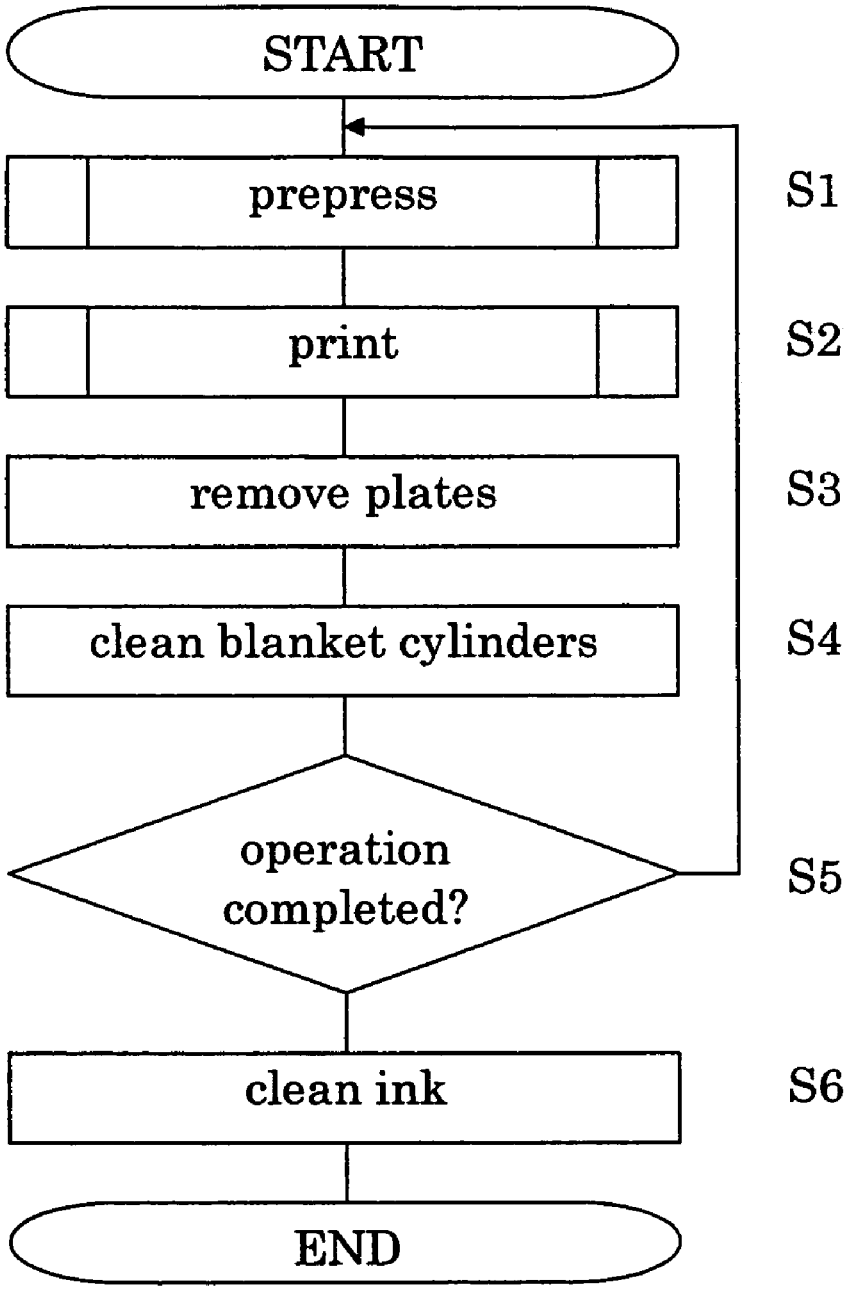
FIG. 7 is a flow chart of prepress and printing operations of the printing machine.

The prepress and printing operations of the printing machine will be described next. FIG. 7 is a flow chart showing an outline of the prepress and printing operations of the printing machine. These prepress and printing operations are directed to multicolor printing of printing paper S with the four color inks of yellow, magenta, cyan and black.

Figure 8:
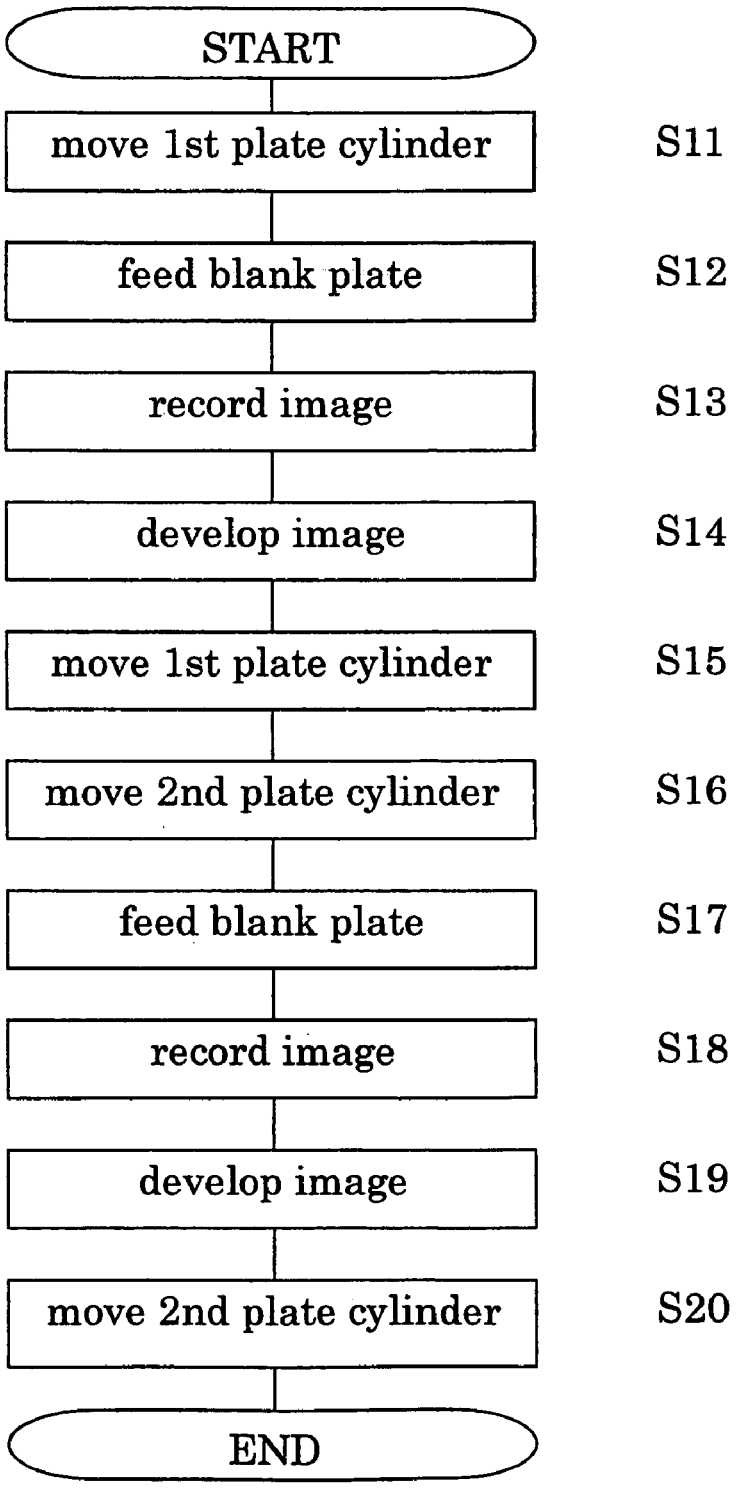
FIG. 8 is a flow chart of a prepress process.

First, the printing machine executes a prepress process for recording and developing images on the plates P mounted on the first and second plate cylinders 11 and 12 (step S1). This prepress process follows the steps constituting a subroutine as shown in the flow chart of FIG. 8.

The first plate cylinder 11 is first moved to the image recording position shown in the two-dot chain line in FIG. 1. (step S11).

Next, a plate P is fed to the outer periphery of the first plate cylinder 11 (step S12). To achieve the feeding of the plate P, the pair of clamping jaws, not shown, clamp the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing machine carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 7, the prepress process is followed by a printing process for printing the printing paper S with the plates P mounted on the first and second plate cylinders 11 and 12 (step S2). This printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. These inks are transferred from the plates P to the corresponding regions of the first and second blanket cylinders 13 and 14, respectively.

Then, the printing paper S is fed to the paper feed cylinder 16. The printing paper S is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper S wrapped around the impression cylinder 15 in its first rotation, and the magenta and yellow inks in its second rotation.

The forward end of the printing paper S printed in the four colors is passed from the impression cylinder 15 to the paper discharge cylinder 17. This printing paper S is transported by the pair of chains 19 toward the paper discharge station 28. After the color densities of the detecting patches are measured at the image pickup station 40, the printing paper S is discharged to the paper discharge station 28.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the blade mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing machine determines whether or not a further image is to be printed (step S5). If a further printing operation is required, the machine repeats steps S1 to S4.

If the printing operation is ended, the printing machine cleans the inks (step S6). For cleaning the inks, an ink cleaning device, not shown, provided for each ink feeder 20 removes the ink adhering to the ink rollers 71 and ink source 72 of each ink feeder 20.

With completion of the ink cleaning step, the printing machine ends the entire process.

<Ink Feeding Rate Control Method According to This Invention>

Figure 9:
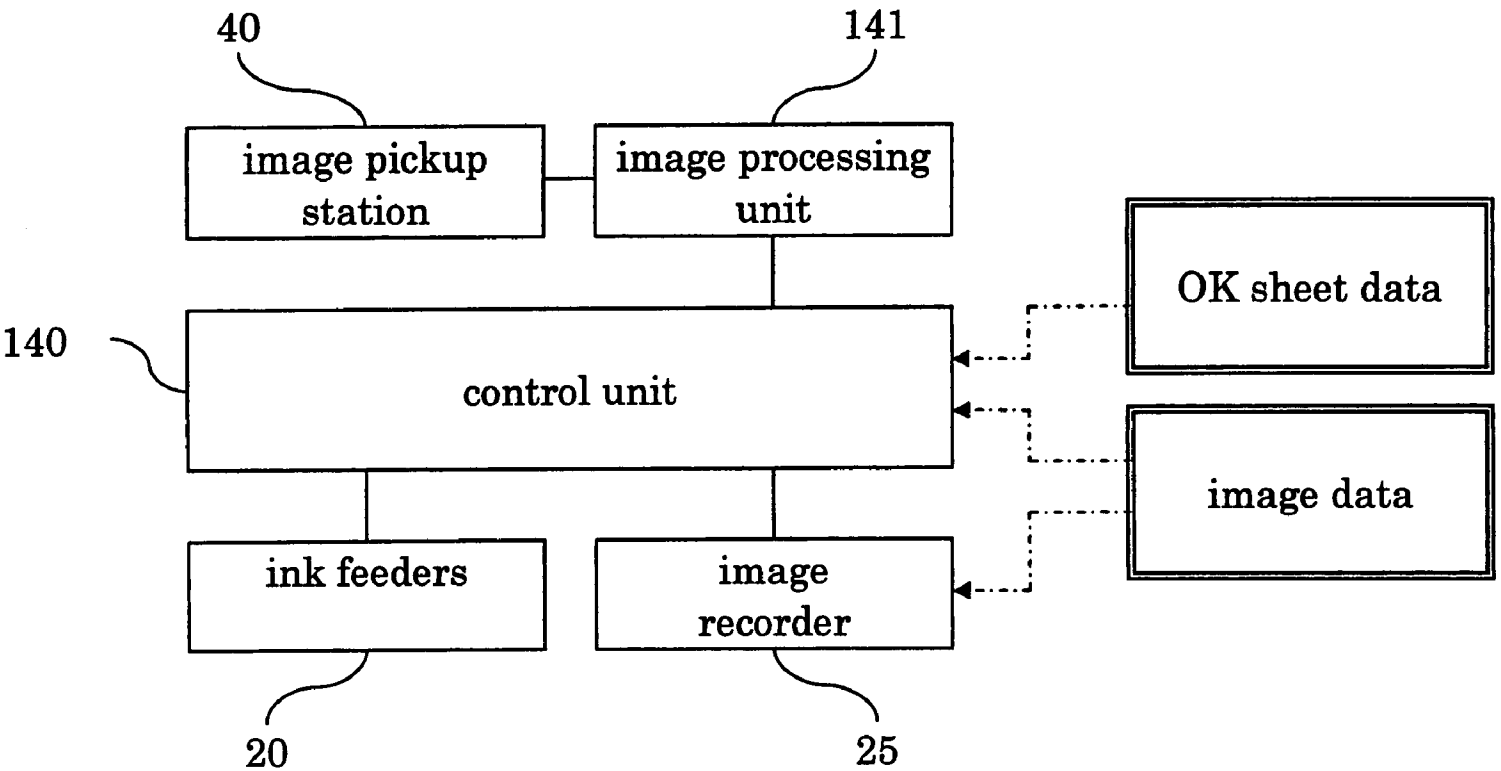
FIG. 9 is a block diagram of a principal electrical structure of the printing machine for implementing an ink feeding rate control method according to this invention.

An ink feeding rate control method according to this invention will be described next. FIG. 9 is a block diagram of a principal electrical structure of the above printing machine for implementing the ink feeding rate control method according to this invention.

The above printing machine includes a control unit 140 for controlling the entire machine. The control unit 140 is connected to the ink feeders 20 and image recorder 25. The control unit 140 is connected also to the image pickup station 40 through an image processing unit 141. The control unit 140 is arranged to receive OK sheet data such as density levels obtained by measuring an OK sheet corresponding to a target print. The control unit 140 and image recorder 25 receive image data corresponding to images to be recorded by the image recorder 25. The image data inputted to the control unit 140 may be relatively coarse image data such as PPF data. The image data inputted to the image recorder 25 is high-density image data passed through a RIP (raster image processor).

Figure 10:
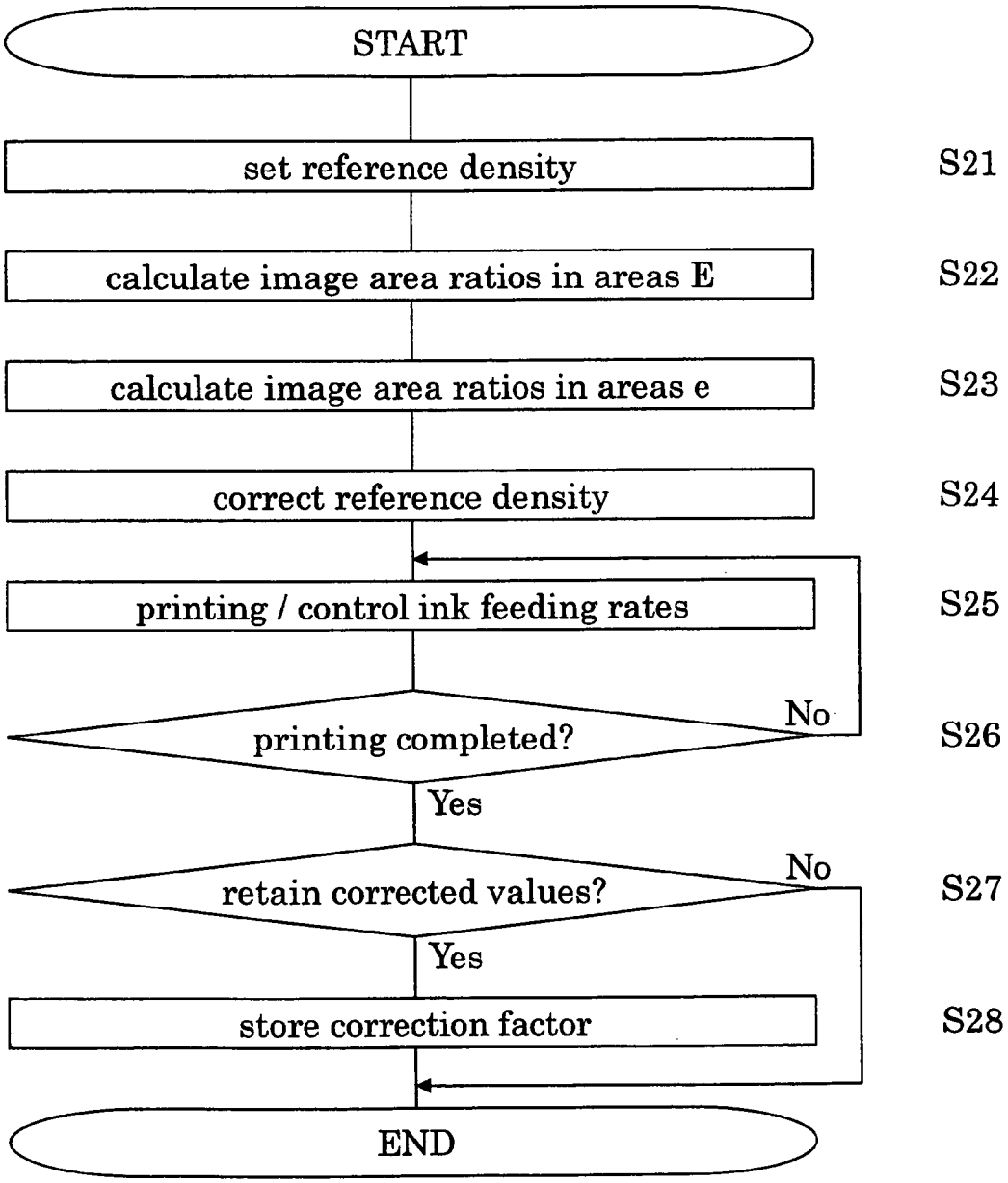
FIG. 10 is a flow chart showing steps in the ink feeding rate control method according to this invention.

FIG. 10 is a flow chart showing steps in the ink feeding rate control method according to this invention.

In performing the ink feeding rate control method according to this invention, a reference density is first set for each of the detecting patches P1, P2, P3 and P4 (step S21). This reference density is set for each color based, for example, on the type of printing paper (whether coated paper or wood free paper).

Next, an average of image area ratios in the areas E1, E2 and so on corresponding to the respective ink keys 2 shown in FIGS. 3 and 4 is calculated for each color of magenta, yellow, cyan and black (step S22). The image area ratios are calculated by using the image data inputted to the control unit 140.

Figure 11:
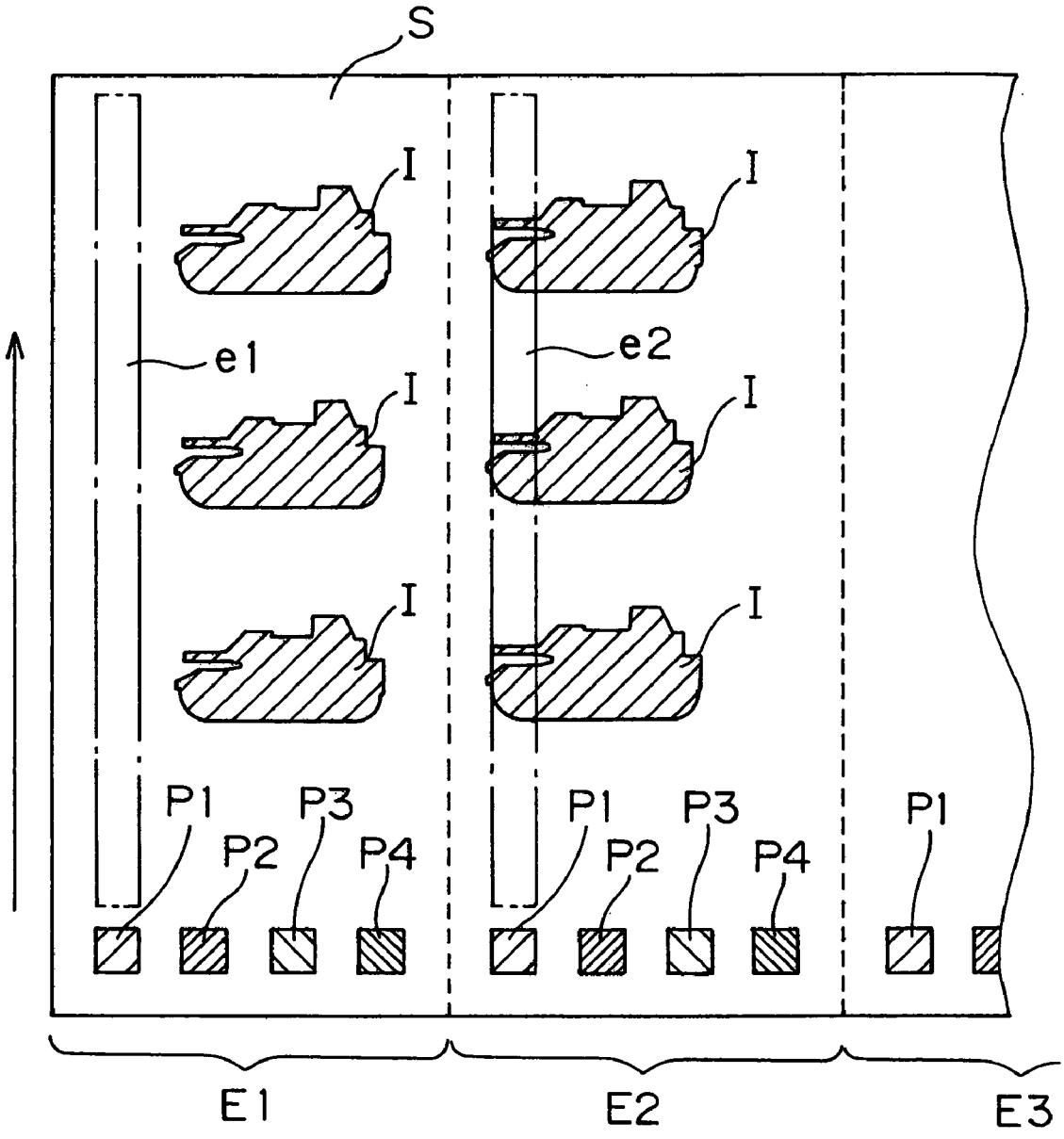
FIG. 11 is an explanatory view schematically showing detecting patches printed on printing paper.

Next, an average of image area ratios of images in positions aligned in the printing direction with the detecting patches P1, P2, P3 and P4, shown in FIG. 11, printed in the areas E1, E2 and so on of the printing paper S corresponding to the respective ink keys 2, is calculated for each color of magenta, yellow, cyan and black (step S23). For cyan, for example, an average is calculated of image area ratios in the areas e1, e2 and so on, each aligned with the detecting patch P1 in the printing direction indicated by an arrow in FIG. 11 (i.e. rectangular areas having substantially the same width as the detecting patches and extending in the printing direction). These image area ratios also are calculated by using the image data inputted to the control unit 140.

Then, a value of reference density set beforehand for each of the detecting patches P1, P2, P3 and P4 is corrected based on the average of image area ratios in the areas E1, E2 and so on corresponding to the respective ink keys 2, and the average of image area ratios of images in the positions aligned in the printing direction with the detecting patches P1, P2, P3 and P4 printed on the printing paper S (step S24).

Linear approximation, for example, is used in determining a corrected value for the reference density. That is, a corrected value is derived from the equation set out below, where Dp is a corrected reference density of each of the detecting patches P1, P2, P3 and P4, Dt is a target density (reference density of ink) of each of the detecting patches P1, P2, P3 and P4 determined from the type of ink or paper, So is an average of image area ratios of each color in the areas E1, E2 and so on corresponding to the respective ink keys 2, Sp is an average of image area ratios of images in the positions aligned in the printing direction with the detecting patches P1, P2, P3 and P4 in the areas E1, E2 and so on, and "a" is a correction factor.

Specifically, to control the feeding rate of cyan ink, a corrected value is derived from the equation set out hereunder by using the corrected reference density Dp of the detecting patches P1, target density Dt, average values So and Sp of the image areas for to the color of cyan, and the correction factor "a". Similarly, to control the feeding rate of magenta ink, a corrected value is derived from the equation set out hereunder by using the corrected reference density Dp of the detecting patches P2, target density Dt, average values So and Sp of the image areas for the color of magenta, and the correction factor "a". To control the feeding rate of yellow ink, a corrected value is derived from the equation set out hereunder by using the corrected reference density Dp of the detecting patches P3, target density Dt, average values So and Sp of the image areas for the color of yellow, and the correction factor "a". Further, to control the feeding rate of black ink, a corrected value is derived from the equation set out hereunder by using the corrected reference density Dp of the detecting patches P4, target density Dt, average values So and Sp of the image areas for the color of black, and the correction factor "a".

$$Dp=a\cdot(So-Sp)+Dt$$

The correction factor "a" is empirically determined beforehand by using print samples of image area ratios of each color arranged at a plurality of stages. Curve approximation may be used instead of the linear approximation noted above, or corrected values of reference density may be determined based on data stored in a look-up table.

Once corrected values of reference density are determined, ink feeding rates are controlled in time of printing by using the corrected values reference density (step S25). That is, the printing machine starts a printing operation. Then, density levels of the detecting patches P1, P2, P3 and P4 on the printing paper S immediately after printing are measured at the image pickup station 40. The density levels measured are compared with the reference density corrected in step S24. Based on results of the comparison, ink feeding rates are adjusted by driving the pulse motor 6 of the ink source 72 in each ink feeder 20 shown in FIG. 3.

When required prints have been made (step S26), it is determined whether the correction of reference density made at this time should be reflected on subsequent printing operations (step S27). That is, the correction factor "a" and other data are stored in the memory of the control unit 140 or the like when it is decided that the data concerning the corrections, such as the correction factor "a", are stored at appropriate times for use in optimizing the reference density for subsequent printing operations (step S28). On the other hand, when it is decided not to use the latest correction of reference density in subsequent printing operations, the current printing operation is terminated with no further action.

In the foregoing embodiment, density levels of the detecting patches P1, P2, P3 and P4 are used as measurement information on the detecting patches P1, P2, P3 and P4. Instead, color information other than density may be used. Further, the detecting patches P1, P2, P3 and P4 may be not only solid patches but also dot patches or line patches.

In the foregoing embodiment, ink feeding rates are automatically controlled by controlling the ink feeders 20 based on collected values of reference density. Instead, the operator may adjust the ink feeding rates from the ink sources 72 directly by using the corrected values of reference density.

<Other Embodiments>

Reference density is corrected in the foregoing embodiment. Instead of correcting reference density, the density measured of each detecting patch may be corrected. Corrected values may be derived from the approximation set out hereunder, for example, where Nt is a density level measured of each detecting patch, Np is a corrected density level of each detecting patch, Mo is an average of image area ratios of each color in the areas E1, E2 and so on corresponding to the respective ink keys 2, Mp is an average of image area ratios of images in the positions aligned in the printing direction with the detecting patches P1, P2, P3 and P4 (i.e. rectangular areas having substantially the same width as the detecting patches and extending in the printing direction) in the areas E1, E2 and so on, and "b" is a correction factor.

$$Np=b\cdot(Mp-Mo)+Nt$$

Of course, curve approximation or a look-up table may be used instead of linear approximation.

In the foregoing embodiment, ink feeding rates are controlled based on density levels of the detecting patches. This invention is applicable not only to the control of the ink feeding rates but also to the control of dampening water feeding rates. To control the dampening water feeding rate in the above printing machine, the rate of feeding dampening water to the surface of a printing plate may be adjusted by varying the rotating rate of each fountain roller 32 shown in FIG. 5. A method of controlling the feeding rate of dampening water based on measured density of detecting patches is described in Japanese Unexamined Patent Publication No. 2002-355950, and will not particularly be described herein.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2003-69790 filed in the Japanese Patent Office on Mar. 14, 2003, the entire disclosure of which is incorporated herein by reference.

What is claimed is:

1. An ink feeding rate control method for controlling a feeding rate of ink for each of areas corresponding to ink keys of an ink feeder in a printing machine, by comparing measurement information and reference information on detecting patches printed on prints, said method comprising the steps of determining an average of image area ratios of images in the areas on said prints corresponding to said ink keys;

determining an average of image area ratios of images in positions aligned in a printing direction with said detecting patches printed in the areas on said prints corresponding to said ink keys; and correcting one of said reference information and said measurement information based on said average of image area ratios of the images in the areas on said prints corresponding to said ink keys, and said average of image area ratios of the images in said positions aligned in said printing direction with said detecting patches printed on said prints.

2. An ink feeding rate control method as defined in claim 1, wherein said measurement information on said detecting patches comprises densities of said detecting patches, and said reference information comprises reference densities.

3. An ink feeding rate control method as defined in claim 1, wherein one of said reference information and said measurement information is corrected by using a correction factor obtained empirically.

4. An ink feeding rate control method as defined in claim 3, wherein a corrected value of one of said reference information and said measurement information is stored from time to time, one of said reference information and said measurement information being corrected in time of subsequent printing processes by using said corrected value stored.

5. An ink feeding rate control method for a printing machine having an image recorder for recording images on a printing plate based on image data, for controlling a feeding rate of ink for each of areas corresponding to ink keys of the ink feeder by comparing measurement information and reference information on detecting patches printed on prints, said method comprising the steps of:

determining, from said image data, an average of image area ratios of images in the areas on said prints corresponding to said ink keys;

determining, from said image data, an average of image area ratios of images in positions aligned in a printing direction with said detecting patches printed in the areas on said prints corresponding to said ink keys; and correcting one of said reference information and said measurement information based on said average of image area ratios of the images in the areas on said prints corresponding to said ink keys, and said average of image area ratios of the images in said positions aligned in said printing direction with said detecting patches printed on said prints.

6. An ink feeding rate control method as defined in claim 5, wherein said measurement information on said detecting patches comprises densities of said detecting patches, and said reference information comprises reference densities.

7. An ink feeding rate control method for controlling a feeding rate of ink for each of areas corresponding to ink keys of an ink feeder in a printing machine, based on measurement information on detecting patches printed on prints, wherein the feeding rate of ink for each of the areas corresponding to the ink keys of the ink feeder is controlled based on an average of image area ratios of images in the areas on said prints corresponding to said ink keys, and an average of image area ratios of images in positions aligned in a printing direction with said detecting patches printed in the areas on said prints corresponding to said ink keys.

8. An ink feeding rate control method as defined in claim 7, wherein said measurement information on said detecting patches comprises densities of said detecting patches.

9. A data correcting method for a printing machine for correcting one of measurement information and predetermined reference information when controlling the printing machine by comparing the measurement information and the reference information, the measurement information being obtained by measuring detecting patches printed on prints and corresponding to ink keys of the printing machine, said method comprising the steps of determining an average of image area ratios of images in the areas on said prints corresponding to said ink keys;

determining an average of image area ratios of images in positions aligned in a printing direction with said detecting patches printed in the areas on said prints corresponding to said ink keys; and correcting one of said reference information and said measurement information based on said average of image area ratios of the images in the areas on said prints corresponding to said ink keys, and said average of image area ratios of the images in said positions aligned in said printing direction with said detecting patches printed on said prints.

10. A data correcting method as defined in claim 9, wherein said measurement information on said detecting patches comprises densities of said detecting patches, and said reference information comprises reference densities.

11. A data correcting method as defined in claim 10, wherein said measurement information and said reference information are used for at least one of ink feeding rate control and dampening water feeding rate control in the printing machine.

12. A data correcting method as defined in claim 9, wherein said measurement information and said reference information are used for at least one of ink feeding rate control and dampening water feeding rate control in the printing machine.

* * * * *